United States Patent [19]

Libit

[11] 4,358,032

[45] Nov. 9, 1982

[54] SNAP CONTAINER CLOSURE

[76] Inventor: Sidney M. Libit, 141 Lakeside Terrace, Glencoe, Ill. 60022

[21] Appl. No.: 219,990

[22] Filed: Dec. 24, 1980

[51] Int. Cl.[3] ..... B65D 5/72

[52] U.S. Cl. ..... 222/498; 222/546; 222/556; 215/355; 215/224; 220/306; 220/283

[58] Field of Search ..... 215/224, 355; 220/281, 220/282, 283, 306; 222/498, 546, 563, 562

[56] References Cited

U.S. PATENT DOCUMENTS

| | | | |
|---|---|---|---|
| Re. 29,793 | 10/1978 | Pehn | 215/224 |
| 3,016,168 | 1/1962 | Larson | 222/498 X |
| 3,187,964 | 6/1965 | Foster | 222/498 X |
| 3,845,872 | 11/1974 | Towns | 215/224 |
| 4,047,495 | 9/1977 | O'Brian | 215/224 |
| 4,257,537 | 3/1981 | Uhlig | 215/225 X |
| 4,261,486 | 4/1981 | Bush | 222/563 X |
| 4,262,802 | 4/1981 | Laanwe | 215/224 X |

*Primary Examiner*—Allen N. Knowles

*Attorney, Agent, or Firm*—Hill, Van Santen, Steadman, Chiara & Simpson

[57] ABSTRACT

A container closure such as a bottle top or the like is provided having a base portion for assembly onto the container forming a top to the container, the base portion having an orifice therethrough set in a generally planer top surface. A top member lies atop the planer surface and has a hinge defining the top member into two portions, one of which has structure for affixing it in face to face relationship with the planer surface on top of the base. The other portion is movable about the hinge from an orifice closing position atop the planer surface to an orifice open position extending at an angle to the planer surface. A flexible tongue extends into the area of the hinge and is capable of undergoing a snap movement from one side to the other of a raised rib in the planer surface to hold the second portion of the top in the orifice open position at an angle to the planer surface. The second portion of the top may be equipped with a stopper insertable into the orifice.

14 Claims, 8 Drawing Figures

FIG. 4
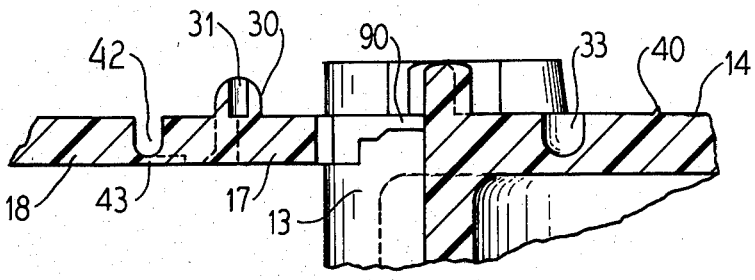
FIG. 5
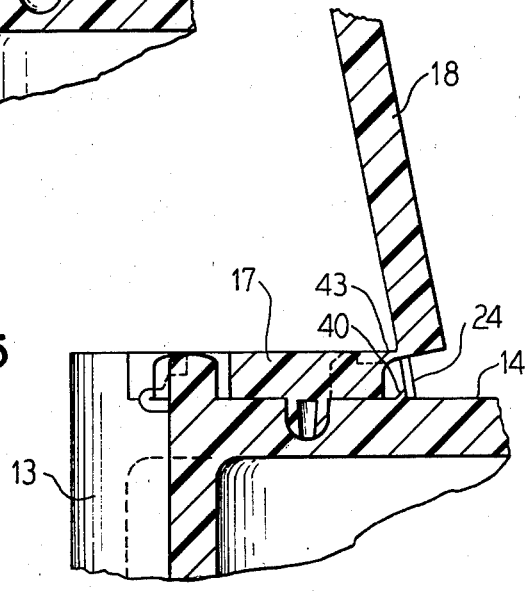
FIG. 6
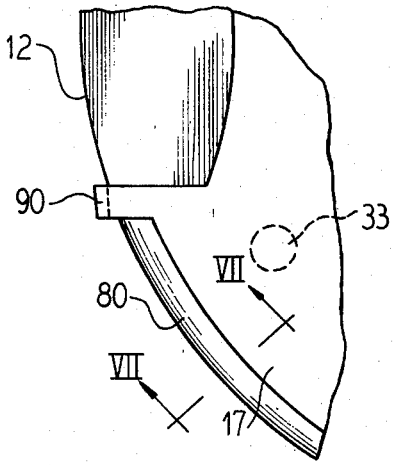
FIG. 8
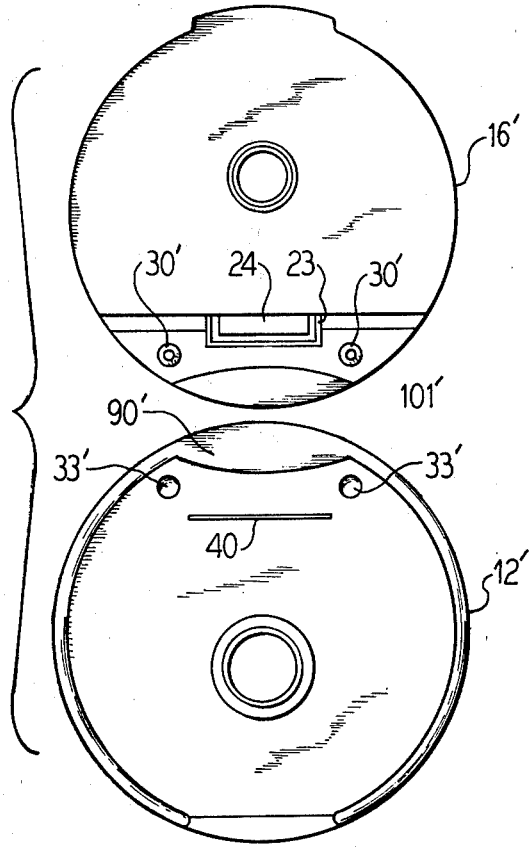
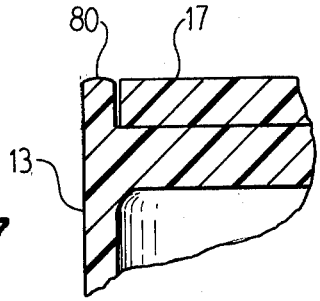
FIG. 7

SNAP CONTAINER CLOSURE

BACKGROUND OF THE INVENTION

1. Field of the Invention

This invention relates to closures, and more particularly to a container closure.

2. Prior Art

One and two piece container closures having a base portion with a top surface and a depending skirt for assembly onto the container with a second piece or portion adapted to close an orifice in the base are known to the art. Recently it has been proposed to form such devices of one piece with a hinge connection between the base portion and a top portion, the top portion having a stopper for insertion into the orifice in the base portion (see for example, U.S. Pat. No. 4,047,495). In some such constructions the top portion is movable about the hinge connection with the base portion from an orifice closed position substantially atop the base portion to an orifice open position at an angle to the base portion. Additionally, means have been provided to maintain the top in the open position, such means being generally characterized as an over-center type connection between the top and the base.

In one specific prior art construction the top is attached to the base at two hinged spaced connections at the periphery of the top and base. A flap formed partially from the peripheral side wall of the base and partially from a central land of the top is hingedly affixed at both the side wall of the base and at the central portion of the top. This substantially right angle member forms an over-center type spring connection such that when the top is in the orifice closed position lying atop the base the over-center member will be in a natural substantially right angled position with one leg lying along the periphery of the base and top and the other leg extending inwardly of the top. As the top is opened from a point on the closure opposite the two spaced hinges, the legs of the over-center member will spread apart until the top reaches a substantially right angle position with respect to the base. Thereafter the resiliency of the substantially right angled over-center member will cause the legs to freely assume the prior right angle relation with the one leg extending radially outwardly from the base. This will maintain the cap in an open position at an angle of greater than 90° to the top of the base.

While such prior art devices generally fulfill the requirement of an easily openable closure while maintaining the closure pieces affixed to one another and while maintaining the open top in an open position allowing free dispensing of the ingredients of the container, they require an expensive and complex mold for their formation out of plastic materials. Additionally, because the hinges are positioned at the periphery of the cap, and project beyond the periphery, automatic cap screw-on machines can strip the hinges. When this occurs the over-center feature will no longer work as desired.

It would therefore be an advance in the art to provide a closure cap having a base portion for a fixture to the container and a top portion movable between a position closing an orifice in the base and a position opening in the orifice in the base, with the top portion being connected to the base and with means to maintain the top portion in the orifice open position.

It would be a further advance in the art if such a closure could be provided which is capable of being inexpensively mold formed with minimal material waste.

SUMMARY OF THE INVENTION

My invention overcomes the disadvantages of the prior art and provides an improved closure cap which may originally be molded as one piece or as two pieces. The cap consists of a base portion having a peripheral depending skirt and a top with an orifice opening therethrough. The skirt, as is known in the art, may be provided with threads internally thereof or other means for attachment to the container. In the preferred form, the top surface of the base is formed with an aperture therein off-center thereof which may be defined by a partially raised circumferential lip in a larger diameter recess in the top surface.

A top for the base is also molded and is provided with a chordal hinge separating the top into first and second portions. The first portion has interference nipples projecting therefrom which are receivable in blind bores in the top surface of the base in tight or interference relationship to affix the first portion of the top to the base with the hinge being positioned chordally of the base. The second portion of the top has a stopper formed therein for closure of the orifice and is hingedly movable from an orifice closed position atop the top surface of the base to an orifice open position at an angle of approximately 100° to the top surface of the base.

Centrally of the hinge I have provided a projecting tongue member carried by the second portion which moves with the second portion and which is engageable with a raised rib on the top surface of the base. As the second portion of the top is moved from the orifice closed position to the orifice open position, the projecting tongue will snap over the rib and will thereafter hold the second portion in the orifice open position.

If desired, the closure may be formed as one piece in a molding operation in which instance the base and the top are connected together by spaced connecting tanges. In order to minimize mold space and plastic use, the base and top may be formed substantially as circles with their centers spaced apart less than the sum of the diameters of the circles. In this construction the top will then be formed with an arcuate unformed peripheral portion to accomodate the decreased spacing between the centers of the top and the base.

If desired, the base may be formed with an axial raised peripheral portion and the top may then be formed with a smaller diameter so that when in the fully closed position the top lies within the raised peripheral bead of the base.

Construction of my closure cap, as disclosed herein, is relatively inexpensive in comparison to the prior art caps. Moreover, because nothing which can affect the operation of the cap extends beyond the periphery the base, any stripping of the periphery that may occur during assembly of the closure to the container will not affect the operation of the snap open top.

It is therefore an object of this invention to provide an improved container closure of the type having a base and an attached snap open top for the base.

It is another, and more specific object of this invention, to provide a container closure having a base member for affixture to the container, the base member having a top surface with an orifice therein, a top member attached to the base member movable from an orifice closing to an orifice open position while remaining attached to the base member, the top member being hingeably connected to the base member and having means for maintaining the top in the orifice open position, the top being formed of two portions each overlying the base, the portions being separated by an integral hinge, one portion moving with respect to the other portion between the orifice closed position and the orifice open position.

It is yet another specific object of this invention to provide a molded plastic closure top having a base portion with an axially extending skirt for affixture to a container, the base portion having a top surface with an orifice therein, a top for the base portion, means connecting the top to the base portion, the top being hinged chordally dividing the top into a first portion and a second portion, the first portion being attached to the base in a base overlying relationship, the second portion being movable with respect to the base and the first portion from a base overlying orifice closing position to an orifice open position with the second portion lying at an angle to the top surface of the base, and snap means between the second portion and the base effective to maintain the second portion in the orifice open position while allowing the second portion to be moved to the orifice closed position upon application of force.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 4 is an enlarged fragmentary sectional view showing the base and top connection of the closure as molded.

FIG. 5 is a view similar to FIG. 4 showing the base to top connection with the first portion locked to the base and the second portion in the orifice open position.

FIG. 6 is a fragmentary top plan view of the container of this invention.

FIG. 7 is a fragmentary cross-section view of the container of this invention taken along the lines vii-vii of FIG. 6.

FIG. 8 is a plan view of another embodiment of this invention with the top formed separately of the base.

DESCRIPTION OF THE PREFERRED EMBODIMENTS

Figure 1:
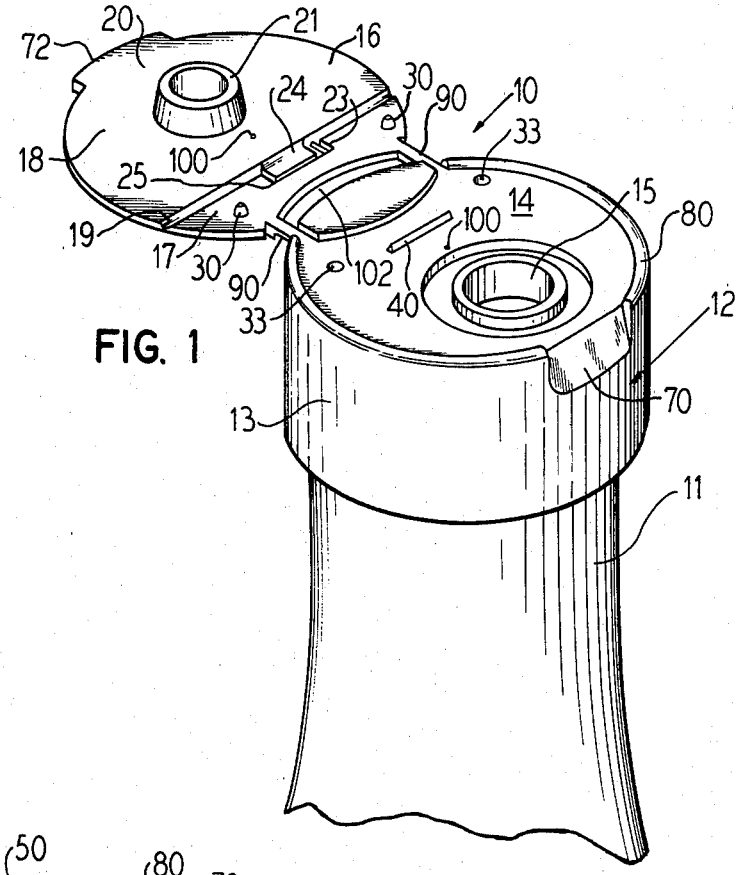
FIG. 1 is a fragmentary perspective view of a container equipped with the closure of this invention.

As illustrated in FIG. 1, this invention is directed to a closure cap 10 of the type affixable to the neck 11 of a container. The cap 10 consists of a base portion 12 which is generally cylindrical having a peripheral axially extending skirt 13 and a closed end having a top surface 14. An orifice 15 is formed through the closed end for dispensing the contents of the container. A top 16 is provided for overlying the top surface 14 of the base 12 and closing the orifice. According to this invention the top 16 is formed with a first portion 17 and a second portion 18 separated by a hinge portion 19. The second portion, on its under surface 20, is provided with a raised stopper 21 for insertion into the orifice 15. The central portion 23 of the hinge is unformed and a tongue or lip 24 formed integrally with the second portion 18 projects into an opening 25 formed in the hinge area 19 and the first portion 17.

Figure 2:
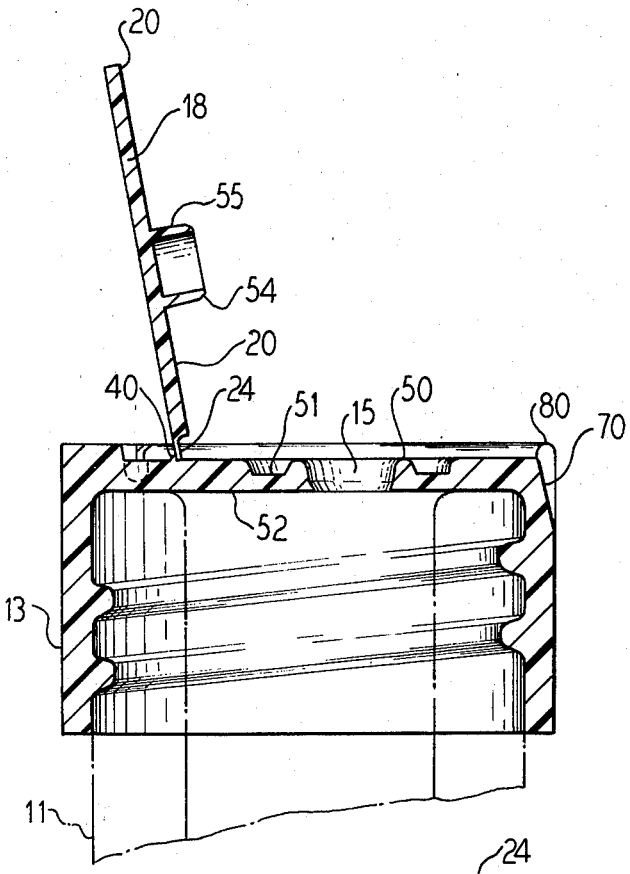
FIG. 2 is a cross-sectional view of the closure received on the neck of a container with the second portion of the top in the orifice open position.
Figure 3:
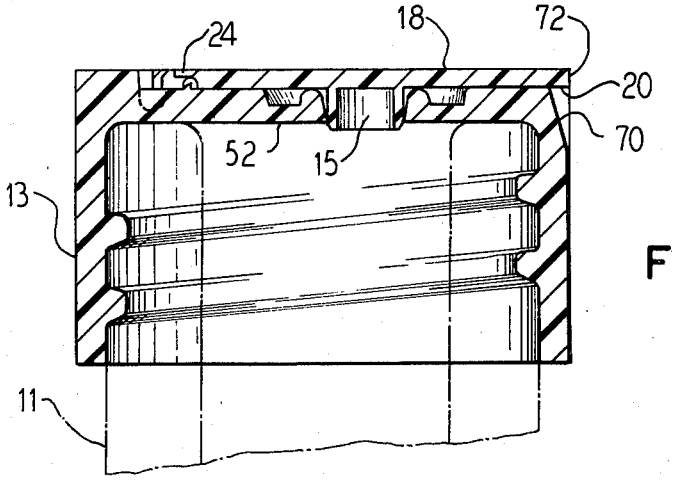
FIG. 3 is a view similar to FIG. 2 illustrating the orifice closed position.

As best illustrated in FIG. 4, the under surface of the first portion 17 is formed with projecting nipples 30 which may be hollow as at 31. The nipples are dimensioned to be inserted, in an interfering relationship in recesses 33 formed in the top surface 14 of the base as shown in FIG. 5. With the nipples inserted, the first portion 17 will be strongly attached to the top of the base with the under surface of the first portion 17 lying atop the top surface 14 of the base. In this position, the second portion 18 will be movable from a top surface 14 overlying position with the stopper 21 in the orifice 15, as shown in FIG. 3, to an orifice open position shown in FIG. 2 by pivoting in relation to the first portion about the hinge 19, the first portion remaining in overlying relationship to the top surface 14 due to the interference fit of the nipples 30 in the recesses 33. As the second portion 18 moves from the position of FIG. 3 to the position of FIG. 2, the tongue or lip 24 will rotate around and over a raised rib 40 formed in the top surface 14. The lip 24, having a dimension greater than the width of the hinge area 19, will bow as it is moved over the top surface 14 in the area immediate adjacent the rib and will bow further as it moves over the rib. As the second portion 18 moves beyond a position perpendicular to the surface 14, the lip or tongue 24 will snap over the rib and will assume a position as shown in FIG. 2 and FIG. 5 where it will retain the second portion 18 in the orifice open position. Preferably the included angle between the surface 14 and the line of projection of the second portion 18 in the orifice open position, as illustrated in FIG. 2 and 18, will be approximately at least 110°.

By forming the hinge area as an arcuate bottomed recess 42 in the under surface of the top, the hinge itself will be provided by the land 43 of plastics material of the closure connecting the first portion 17 and the second portion 18.

As will be seen from reference to FIG. 5, when the second portion 18 is in the orifice open position the land 43 will have been distorted by the hinge movement. The resistance of the land 43 to further distortion will maintain a resilient force against further pivoting of the second portion 18 of the top while the tongue 24, in engagement with the rib and the surface 14 adjacent the rib 40, will provide a resilient force restricting the second portion 18 from pivoting towards the orifice closed position. Because of the resistance of the land 43, the second portion will be restrained against a further opening movement and, because of the resistance of the tongue 24, the second portion 18 will be restricted against an orifice closing movement. In this manner, the second portion 18 will be maintained in the orifice opening position projecting from the surface 14 at an angle thereto greater than 90°.

In this manner, the tongue 24 cooperates with the rib 40 to provide an over center snap resilient brace for the second portion 18 of the top 16.

Because the hinge portion 19 is formed chordally of the top 16, and because the first portion is firmly affixed to the top surface 14 of the base, the second portion 18 will, in the orifice open position, project from the base at a chord line less than the full diameter of the base.

Although the top 16 can, if desired, be formed cup-shaped, it is preferred if it is formed substantially planer. Therefore, so that the stopper 21 may properly affix with the orifice 15, the orifice may be defined by a circumferential raised bead 50 formed around the orifice 15 within a recessed portion 51 of the surface 14. Preferably, the throat opening of the orifice 15 formed from the top of the bead 50 to the under side 52 of the top of the base is conically angled so that the orifice has a smaller diameter at the under surface 52 than at the top of the bead. By bevelling the stopper bottom as at 54 while maintaining the stopper full diameter as at 55 larger than the smallest diameter of the aperture, the resiliency of the plastic forming the aperture wall will provide a holding force maintaining the second portion 18 of the top 16 in the orifice closed position shown in FIG. 3.

Further, a portion of the periphery of the base may be bevelled as at 70 in FIG. 2 and FIG. 3, and the top 16 may be formed with a thumb projection 72 whereby the second portion 18 may be easily moved to the orifice open position by pressing the under surface 20 of the tange 72 in the area of the bevel 70.

Further, in order to provide an aesthetic looking cap, I form a raised circumferential bead 80 around the periphery of the surface 14. By forming the top 16 of a diameter equal to the inside diameter of the bead 80, and by raising the bead 80 approximately the thickness of the top 16, the top when in the orifice closed position will provide a smooth substantially continuous surface from the bead.

In the embodiment shown in FIG. 1, the top 16 is formed integral with the base and is attached thereto, during the molding, by circumferentially spaced apart tanges 90. The bead 80 is interrupted in the area of the tanges 90. As the closure is assembled, the portion 18 is folded over the top of the base causing the tanges 90 to be folded over. For this reason, the tanges are maintained relatively thin in the molding process as shown in FIG. 4.

As shown in FIG. 6, the folded over tanges may project outwardly beyond the circumference of the base 12 and therefore may be susceptible to rubbing off during automatic cap installation. However, because they form no portion of the operating characteristics of the hinged snap open cap, if they are damaged during the closure to container assembly, there will no adverse effect on the closure.

Further, as illustrated in FIG. 1, I have found that the cap of this invention can be made in a reduced mold space by theoretically overlapping the top and base. Thus, as illustrated, the center points 100 of the base and top are spaced apart a distance less than the total distance of the two diameters of the base and top. In order to provide for this, an arcuate portion 101 of the top is not formed and an opening 102 is left between the periphery of the base 12 and the body of the top 16, the opening 102 being defined at its outer circumferential edges by the tanges 90. In this instance, the bead 80 in the area between the tanges 90 is increased in radial thickness to accomodate the unformed portion 101 when the first portion 17 of the top 16 is attached in overlying relationship to the surface 14 of the base.

As shown in FIG. 8, however, this cap may also be formed of two pieces, a separate base piece 12' and a separate top piece 16'. In that instance, if desired, an arcuate portion 101' of the top may also be unformed and the bead 90' of the base may be correspondingly thickened. This can assist in retaining the top 16' in proper alignment with the base 12' when the nipples 30' are inserted into the recesses 33'. Alternatively, if desired, the portion 101' may be omitted and the top 16' fully formed as a completed disc.

It can therefore be seen from the above that this invention provides an improved closure cap of the type which can be molded out of inexpensive plastics materials, such as polypropylene, polyethylene, and the like, and which consists of two portions, a base portion having a depending skirt for engagement with a container, the base portion being closed by a top surface with an orifice therein, and a top portion hinged to the base portion, the top portion having a stopper for closing the orifice, a portion of the top portion being hingedly movable from an orifice closed position to an orifice open position, with resilient means maintaining the top in the orifice open position. According to this invention the top is formed of first and second portions separated by an integral hinge portion with the first portion formed with interlock means for interlocking with the base top in face to face overlap relation, the second portion containing the stopper and being hingedly movable from the orifice open to the orifice closed position.

Although the teachings of my invention have herein been discussed with reference to specific theories and embodiments, it is to be understood that these are by way of illustration only and that others may wish to utilize my invention in different designs or applications.

I claim as my invention:

1. A closure cap comprising a base portion for attachment to a container and a top portion, the base having an orifice therethrough, the top being adapted to close the orifice, said top including a hinge dividing the top into first and second portions, means for attaching the first portion to the base in base overlying non-moving relationship spaced from the orifice, the second portion being movable from an orifice closing position to an orifice open position by bending about said hinge when the first portion is in the attached base overlying relationship and means for retaining the second portion in the orifice open position.

2. A closure cap having a base portion and a top portion hingeably secured thereto, the improvement of the top portion having an integral hinge chordally thereof, means affixing the top on one side of the chordal hinge securely to the base in base overlying non-pivoting flat relationship to the base spaced from a base orifice, the portion of the top on another side of the hinge being pivotable about said hinge from a base overlying orifice closing position to a dispensing position at an angle to the base overlying orifice closing position while the said top on one side of the chordal hinge remains affixed to the base, and resilient means to maintain the dispensing position.

3. A device according to claim 2 wherein the base includes a top surface having an orifice therein eccentric thereof and the portion of the top lying on another side of the hinge has a projecting stopper insertable into the orifice when in the base overlying position.

4. A plastic closure cap comprising a base portion having a dependent peripheral skirt with inner diameter means for affixing the skirt to a container, the base portion having a top surface with an eccentric orifice therein, an integral top portion attached to the base portion, the top portion having a chordal integral hinge formed therewith dividing the top portion into first and second sections, the first section having means cooperating with means on the top surface of the base for affixing the first section to the base in base overlying relationship, the second section being pivotable about said hinge from a base overlying position to a dispensing position at an angle to the top surface of the base, a tongue projecting from the second section engageable with a rib projecting from the top surface of the base in the area of the hinge, the tongue providing a resilient means maintaining the second section in the dispensing position, the second section being provided with a stopper for insertion into the orifice.

5. A device according to claim 4 wherein the top and base are interconnected together by circumferentially spaced connections between the first section and the base.

6. A device according to claim 5 wherein the base and top are at least part circular having their centers spaced apart a distance less than the sum of the diameters of the part circles.

7. The device of claim 6 wherein the top is formed from a part circle having a diameter less than the diameter of the circle of the base, the base having a raised peripheral bead projecting above the top surface, the top being receivable interior of the bead.

8. A plastic container closure comprising a base section with a means for affixing the base to a container, the base having an orifice therein, a top, the top having an integral hinge extending chordally thereof dividing the top into first and second sections, means on the first section cooperating with means on the base for affixing the first section to the base in base overlying non-moving relation spaced from the orifice, the second section being pivotable about said hinge from a base overlying orifice closing position to a dispensing position with the second section lying at an angle greater than 90° to the base while the first section remains affixed to the base and resilient means maintaining the second section in the dispensing position.

9. The device of claim 8 wherein the means on the first section comprise projecting nipples and the means on the base comprise openings into which the nipples may be inserted, the nipples and openings dimensioned to provide a tight fit.

10. The device according to claim 9 wherein the tight fit is an interference fit.

11. The device according to claim 9 wherein the resilient means comprise a projecting tongue extending from the second section in the area of the hinge, the tongue cooperating with a raised rib on the base.

12. The device according to claim 11 wherein the top is formed separately of the base.

13. The device according to claim 11 where the top is formed integrally with the base and is connected thereto through two spaced apart tanges connecting the base to the first section.

14. The device according to claim 13 wherein the top and base are substantially circular and have their centers spaced apart less than the sum of the diameters thereof.

* * * * *